US012723779B2

(12) United States Patent
Stahl

(10) Patent No.: US 12,723,779 B2
(45) Date of Patent: Sep. 1, 2026

(54) DEVICE FOR HEATING ROOM AIR AND A LIQUID

(71) Applicant: TRUMA GERAETETECHNIK GMBH & CO. KG, Putzbrunn (DE)

(72) Inventor: Bernhard Stahl, Putzbrunn (DE)

(73) Assignee: Truma Geraetetechnik Gmbh & Co. KG, Putzbrunn (DE)

( * ) Notice: Subject to any disclaimer, the term of this patent is extended or adjusted under 35 U.S.C. 154(b) by 391 days.

(21) Appl. No.: 18/570,217

(22) PCT Filed: Oct. 28, 2022

(86) PCT No.: PCT/EP2022/000101

§ 371 (c)(1),
(2) Date: Dec. 14, 2023

(87) PCT Pub. No.: WO2023/072425

PCT Pub. Date: May 4, 2023

(65) Prior Publication Data

US 2024/0384894 A1 Nov. 21, 2024

(30) Foreign Application Priority Data

Oct. 29, 2021 (DE) ..... 102021005382.6

(51) Int. Cl.
*F24H 15/10* (2022.01)
*F24H 6/00* (2022.01)
*F24H 15/335* (2022.01)

(52) U.S. Cl.
CPC ..... *F24H 15/335* (2022.01); *F24H 6/00* (2013.01); *F24H 15/10* (2022.01)

(58) Field of Classification Search
CPC ..... F24H 15/335; F24H 3/085; F24H 15/429; F24H 3/087; F24H 15/345; F24H 1/08; F24H 15/10; F24H 6/00
See application file for complete search history.

(56) References Cited

U.S. PATENT DOCUMENTS 2,827,893 A 3/1958 Ribaudo et al.
2011/0115223 A1* 5/2011 Stahlkopf ..... H02P 9/04 290/7

(Continued)

FOREIGN PATENT DOCUMENTS

DE 2224711 A1 11/1973
EP 0262263 A1 4/1988
EP 2614971 A1 7/2013

*Primary Examiner* — Alfred Basichas
(74) *Attorney, Agent, or Firm* — McNees Wallace & Nurick LLC

(57) ABSTRACT

Example embodiments relate to a device for heating room air and a liquid. Room air enters and exits the device via an air inlet and an air outlet, and the liquid enters and exits the device via a liquid inlet and a liquid outlet. The heat transfer device transfers the thermal energy produced by an energy unit to the liquid in an interaction area of a medium line. A conveying device moves liquid between a medium container and the medium line. A control unit controls the conveying device and/or the energy unit. In case the device is intended to heat only room air in an air mode, the control unit, in a preparation step, controls the conveying device and/or the energy unit such that liquid runs out of the medium line due to the gravitational force and/or liquid in the medium line is heated up to an evaporation temperature.

6 Claims, 1 Drawing Sheet

(56) References Cited

U.S. PATENT DOCUMENTS

| | | | | |
|---|---|---|---|---|
| 2017/0108233 | A1* | 4/2017 | Howard | F24S 10/742 |
| 2019/0212033 | A1 | 7/2019 | Consadori et al. | |
| 2022/0371395 | A1* | 11/2022 | Weissenbach | B60H 1/0073 |
| 2024/0247836 | A1* | 7/2024 | Hartmann | F24H 15/335 |

* cited by examiner

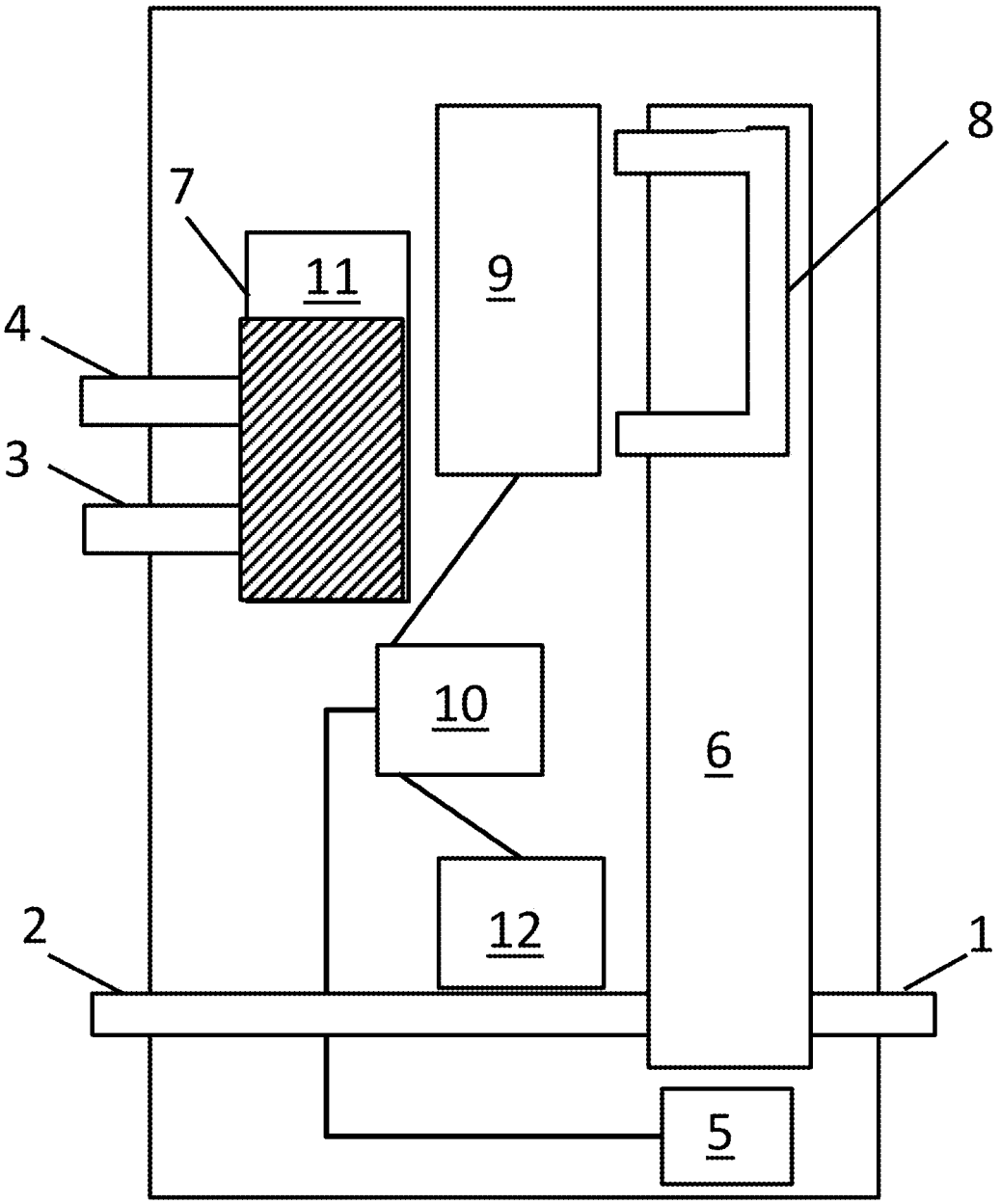
8
7
11
9
4
3
10
6
12
2
1
5

DEVICE FOR HEATING ROOM AIR AND A LIQUID

FIELD OF DISCLOSURE

The present disclosure relates to a device for heating room air and a liquid.

BACKGROUND

In the prior art, it is known to produce thermal energy from the combustion of propane, butane or Diesel fuel converted into the gaseous state, for example, and to transfer it to a liquid, for example raw water or room air, by means of at least one heat exchanger. It is also known to heat room air and liquid (see US 2019/0212033 A1, for example).

The object on which the present disclosure is based is to propose a device for heating room air and a liquid which constitutes an alternative to the prior art.

SUMMARY

The object is achieved by the present disclosure by a device for heating room air and a liquid, comprising an air inlet, an air outlet, a liquid inlet, a liquid outlet, an energy unit, a heat transfer means, a medium container, a medium line, a conveying device, and a control unit, wherein room air to be heated enters the device via the air inlet, wherein heated room air exits the device via the air outlet, wherein liquid to be heated enters the device via the liquid inlet, wherein heated liquid exits the device via the liquid outlet, wherein the energy unit produces thermal energy, wherein the heat transfer means transfers the thermal energy produced by the energy unit to the room air and/or the liquid, wherein the medium container serves to receive the liquid, wherein the medium line serves to conduct the liquid, wherein the heat transfer means and the medium line are configured and arranged relative to each other such that the heat transfer means transfers thermal energy to liquid present in the medium line, wherein the conveying device serves to move liquid from the medium container to the medium line, and from the medium line to the medium container, wherein the control unit controls the conveying device and/or the energy unit, and wherein in case the device is intended to heat only room air in an air mode, the control unit, in a preparation step, controls the conveying device and/or the energy unit such that liquid runs out of the medium line due to the gravitational force and/or liquid in the medium line is heated up to an evaporation temperature of the liquid.

The device according to the present disclosure has inlets and outlets for the room air to be heated and a liquid to be heated or to be warmed up such as raw water, for example. At least the liquid can be stored in a medium container. Furthermore, the liquid can be conducted through a medium line, a conveying device being provided therefor. A heat transfer means transfers thermal energy to the room air and/or the liquid. The liquid conducted through the medium line and passing at least through an interaction area of the heat transfer means is heated. The heat transfer means and the medium line are arranged relative to each other accordingly. The room air is guided past the heat transfer means in a corresponding manner. As shown in the configurations below, the device allows for example to purposefully switch between the media to be heated, i.e., the liquid and room air. Prior to an air mode in which the device is intended to heat only room air, the medium line is emptied with respect to the liquid in that it is drained due to the force of gravity or evaporated. This is carried out in that in a preparation step, i.e., prior to the actual air mode, the control unit controls the conveying device and/or the energy unit such that the liquid runs out of the medium line due to the gravitational force and/or is heated in the medium line over the evaporation temperature thereof. The relevant part of the medium line is respectively that located in an effective area of the heat transfer means. Therefore, the liquid which could absorb thermal energy via the heat transfer means is primarily removed. For the discharge due to the gravitational force and thus using the force of gravity, the relevant part of the medium line opens, for example, above the medium container. The control of the conveying device consists for example in that no liquid is conveyed or a negative pressure is generated even in the direction of an opening of the relevant part of the medium line. The alternative or additional evaporation is carried out, for example, by increasing the thermal energy produced by the energy unit. Alternatively or additionally, the transport of the liquid is interrupted until the liquid has been in interaction with the heat transfer means long enough and has absorbed sufficient thermal energy. Evaporation, in contrast to the use of the force of gravity, has the advantage of being applicable for more geometric configurations and arrangements of the components involved. In one configuration, the liquid runs out first, and the remainder is evaporated.

One configuration provides that the medium container serves to receive liquid and air, and that an air cushion is provided in the medium container. During operation, the medium container is thus not entirely filled with the liquid, rather, part of the volume remains in which an air cushion is formed. During operation—and in particular during the initial start-up—the filling and draining of the medium container is therefore controlled accordingly, such that an air cushion is formed. The air cushion also allows the liquid to evaporate. The air in the air cushion is not room air to be heated which is purposefully heated by the device, but is functional or working air. In one configuration, the air cushion results from an additional connection between the medium container and the exterior air around the device.

One configuration consists in that the medium line serves to conduct liquid and air and in that the conveying device serves to move liquid and/or air from the medium container to the medium line, and from the medium line to the medium container. In this configuration, the liquid branch of the device also contains air which is conveyed through the medium line. In this configuration, it is thus possible to purposefully convey air from the air cushion through the medium line. This air is not to be confused with the room air to be heated.

One configuration consists in that in case the device is intended to heat either only liquid or liquid and room air, the control unit controls the conveying device such that liquid flows from the medium container to the medium line, and from the medium line to the medium container. During this passage of the liquid through the medium line, the heat transfer means transfers thermal energy to the liquid.

One configuration consists in that the device further includes a fan for conveying the room air from the air inlet to the air outlet. This involves a configuration in which the control unit controls the fan such that room air flows from the air inlet via the heat transfer means to the air outlet in case the device is intended to heat either only room air or liquid and room air. The fan conveys room air such that the heat transfer means transfers thermal energy to the room air and thus heats it.

One configuration consists in that the energy unit produces thermal energy by the combustion of a fuel-air-mixture and/or by converting electrical energy.

BRIEF DESCRIPTION OF DRAWINGS

More specifically, there are a large number of possibilities to configure and further develop the device according to the invention. To this end, reference is made to the description below of example embodiments in conjunction with the drawing, in which:

FIG. 1 shows a schematic representation of a device.

FIG. 1 schematically shows the structure of a device for heating room air and a liquid.

DETAILED DESCRIPTION OF EXAMPLE EMBODIMENTS

The room air enters the device through the air inlet 1 and exits it in a heated state through the air outlet 2. The liquid, water, for example, enters the device via the liquid inlet 3 and leaves it in a warmed up (heated) state via the liquid outlet 4. In the variant shown, the thermal energy for heating is generated by the energy unit 5 by the combustion of a fuel-air-mixture. Depending on the mode, the heat transfer means 6 transfers the thermal energy to the room air or to the liquid or, for example, both to the room air and the liquid. To this end, the room air is guided from the air inlet 1 through a fan 12, along or past the heat transfer means 6 to the air outlet 2. A medium container 7 is provided for the liquid, which is connected to the liquid inlet 3 and to the liquid outlet 4 and a medium line 8. The medium container 7 does not only receive the liquid, but also air in an air cushion 11. This air is not the room air to be heated by the device, but is used for the functioning of the device and the cooperation of the individual components. The liquid flowing through the medium line 8 can absorb thermal energy from the heat transfer means 6. The flow of the liquid is generated by the conveying device 9 which comprises at least one pump, for example. The conveying device 9 is controlled by the control unit 10, which in this configuration also switches between the different modes of operation based on a user setting.

It is indicated that the medium line 8 which is in contact with the heat transfer means 6 is located above the medium container 7. This is to illustrate that in case no liquid is conveyed through the medium line 8, the liquid, due to the gravitational force, can flow out of the relevant section of the medium line 8 and thus downwards in the direction of the gravitational force. Due to the geometry of the medium line 8, a certain residual liquid can remain in the interaction area of the medium line 8 and the heat transfer means 6.

If only room air is to be heated in an air mode, the control unit 10 frees the medium line 8 from any remaining liquid in a preparation step by heating the liquid above the evaporation temperature thereof. To this end, the control unit 10 acts both on the conveying device 9 and the energy unit 5. In one variant, evaporation takes place by not conveying any liquid through the medium line 8 for a sufficiently long time so that only the remaining liquid receives thermal energy from the heat transfer means 6. Alternatively, the energy unit 5 is controlled so as to supply more thermal energy. Furthermore, the conveying device 9 alternatively or additionally acts as a fan which removes the already evaporated liquid from the medium line 8.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A device for heating room air and a liquid, comprising:
- an air inlet, an air outlet, a liquid inlet, a liquid outlet, an energy unit, a heat transfer device, a medium container, a medium line, a conveying device and a control unit,
- wherein room air to be heated enters the device via the air inlet,
- wherein heated room air exits the device via the air outlet,
- wherein liquid to be heated enters the device via the liquid inlet,
- wherein heated liquid exits the device via the liquid outlet,
- wherein the energy unit produces thermal energy,
- wherein the heat transfer device transfers the thermal energy produced by the energy unit to the room air and/or the liquid,
- wherein the medium container serves to receive the liquid,
- wherein the medium line serves to conduct the liquid,
- wherein the heat transfer device and the medium line are configured and arranged relative to each other such that the heat transfer device transfers thermal energy to liquid present in the medium line,
- wherein the conveying device serves to move liquid from the medium container to the medium line, and from the medium line to the medium container,
- wherein the control unit controls the conveying device and/or the energy unit, and
- wherein in case the device is intended to heat only room air in an air mode, the control unit, in a preparation step, controls the conveying device and/or the energy unit such that liquid runs out of the medium line due to the gravitational force and/or liquid in the medium line is heated up to an evaporation temperature of the liquid.

2. The device according to claim 1, wherein the medium container serves to receive liquid and air, and wherein an air cushion is present in the medium container.

3. The device according to claim 2, wherein the medium line serves to conduct liquid and air, and wherein the conveying device serves to move liquid and/or air from the medium container to the medium line, and from the medium line to the medium container.

4. The device according to claim 1, wherein in case the device is intended to heat either only liquid or liquid and room air, the control unit controls the conveying device such that liquid flows from the medium container to the medium line, and from the medium line to the medium container.

5. The device according to claim 1, wherein the device further has a fan for conveying the room air from the air inlet to the air outlet.

6. The device according to claim 1, wherein the control unit is configured such that in case the device is intended to heat only room air in an air mode, the control unit, in a preparation step, controls the conveying device and/or the energy unit such that liquid in the medium line is heated up to an evaporation temperature of the liquid.

* * * * *